United States Patent [19]

Nelson

[11] Patent Number: 4,718,589

[45] Date of Patent: Jan. 12, 1988

[54] STOCK MATERIAL FEED MECHANISM

[76] Inventor: James O. Nelson, 35440 Beachpark Dr., Eastlake, Ohio 44094

[21] Appl. No.: 871,804

[22] Filed: Jun. 9, 1986

[51] Int. Cl.[4] ..... B65H 20/00

[52] U.S. Cl. ..... 226/142

[58] Field of Search ..... 226/142, 141

[56] References Cited

U.S. PATENT DOCUMENTS

| | | | |
|---|---|---|---|
| 3,368,437 | 2/1968 | Bennet | 226/142 X |
| 3,900,142 | 8/1975 | Burtch et al. | 226/142 X |
| 4,350,090 | 9/1982 | Busse et al. | 226/142 X |

*Primary Examiner*—Staurt S. Levy

*Assistant Examiner*—Steven M. duBois

*Attorney, Agent, or Firm*—Tarolli, Sundheim & Covell

[57] ABSTRACT

An apparatus for adjusting a stroke of a stroke material feed mechanism used in a punch crank press comprises a throw member fixedly attached to the crank shaft of the press for joint rotation therewith. A crank pin means which provides for reciprocal movement of the feed block of the feed mechanism is attached to the throw member. Motor means displaces the crank pin means relative to the throw member to change the eccentricity of said crank pin means relative to the axis of the crank shaft whereby the amount of stock length advanced into the working area of the press is changed.

7 Claims, 4 Drawing Figures

STOCK MATERIAL FEED MECHANISM

FIELD OF THE INVENTION

The present invention relates to an apparatus for adjusting a feed mechanism for feeding stock material or the like, and, specifically, for feeding metal stock material intermittently to a punch press that performs repetitive operations on the stock material.

DESCRIPTION OF THE PRIOR ART

Feed mechanisms for feeding metal stock material intermittently into the working area of a punch press are known. A feed mechanism synchronizes the advance of the stock material with the press operation such that the stock material is advanced when the working surfaces of respective dies are separated from the stock material upon which they operate. Typically, the feed mechanism is driven by a crank mechanism operatively coupled to a crank shaft of the punch press. The crank mechanism usually includes a crank pin means mounted on a throw member carried by the crank shaft of the punch press and crank link means that extends between the crank pin means and the feed mechanism for imparting reciprocating movement to the feed block of the feed mechanism. The crank pin means is mounted on a throw member in an offset position relative to the axis of the punch press crank shaft. The distance between the axes of the crank shaft and the crank pin means defines the crank arm of the feed mechanism. The length of the stroke of the feed mechanism is directly proportional to the length of the crank arm.

Adjustment of the stroke of the feed mechanism is effected by changing the length of the crank arm. The crank arm is adjusted by changing the degree of eccentricity of the crank pin means relative to the axis of the crank shaft of the punch press. The degree of eccentricity of the crank pin means is changed by moving the crank pin means relative to the throw member. The apparatus for moving the crank pin means generally includes a threaded rod attached to the throw member and a nut associated with the crank pin means and movable along the threaded rod.

A typical stock material feed mechanism in which the length of the crank arm is adjusted by changing the eccentricity of the crank pin means relative to the axis of the crank shaft is shown in U.S. Pat. No. 1,959,853. The main drawback of the mechanism of U.S. Pat. No. 1,959,853 is that the eccentricity of the crank pin means is changed by manually rotating the threaded rod. This operation is time-consuming and presents a serious safety hazard as the operator has to climb high on the press to effect the adjustment.

Accordingly, the object of the present invention is to provide a device for automaticaly adjusting the eccentricity of the crank pin means and thereby the length of the stroke of the stock feed mechanism for a punch press.

SUMMARY OF THE INVENTION

The present invention comprises an apparatus for automatically adjusting the eccentricity of the crank pin means upon actuation by a press operator to thereby adjust the length of the stroke of the feed mechanism. The adjusting apparatus according to the present invention comprises a motor for automatically rotating the threaded rod in response to actuation of the motor by the press operator.

The apparatus of the present invention comprises a throw member mounted on a punch press crank shaft and which carries a threaded rod. The threaded rod is supported for rotation in two support plates attached to the throw member transverse thereto. The distance between the support plates is chosen such that it provides for a predetermined range of adjustments of the crank arm. The threaded rod is connected with a crank pin means comprising a nut that engages the threaded rod. A reversible motor, preferably an air motor, is mounted on the throw member for rotating the threaded rod in response to actuation of the motor. A drive connects the motor shaft with an extension of the threaded rod to effect rotation of the threaded rod. The air for operating the motor is conducted to the motor through channels provided in the crank pin means. The air is conducted through flexible conduits to the crank pin means from a source of air. To prevent the conduits leading from the source from twisting upon rotation of the throw member, a conventional union is used to connect the conduits to the crank pin means. The union permits relative rotation between the crank pin means and the flexible conduits leading from the source of air.

The apparatus of the present invention is also provided with a preset drag brake that locks the threaded rod against rotation and thereby locks the crank pin means in a predetermined position after adjustment is completed.

The apparatus rotates with the crank shaft of the punch press and includes means for balancing the weight of the apparatus on the crank shaft so that adverse forces do not act on the crankshaft. Specifically, the threaded rod has an extension mounted for rotation with the throw member which is formed generally as a circular plate symmetrical with respect to the crankshaft. A third support plate is attached to the throw member for supporting the extension of the threaded rod. The drag brake acts on the extension of the threaded rod and is in the preferred embodiment located beneath the third plate. The foregoing structure assures that the adjusting apparatus is substantially balanced on the crank shaft.

BRIEF DESCRIPTION OF THE DRAWINGS

Further objects and advantages of the present invention will become apparent to those skilled in the art from considering the following detailed description of a preferred embodiment of the present invention with reference to the accompanying drawings, wherein.

DESCRIPTION OF THE PREFERRED EMBODIMENT

Figure 1:
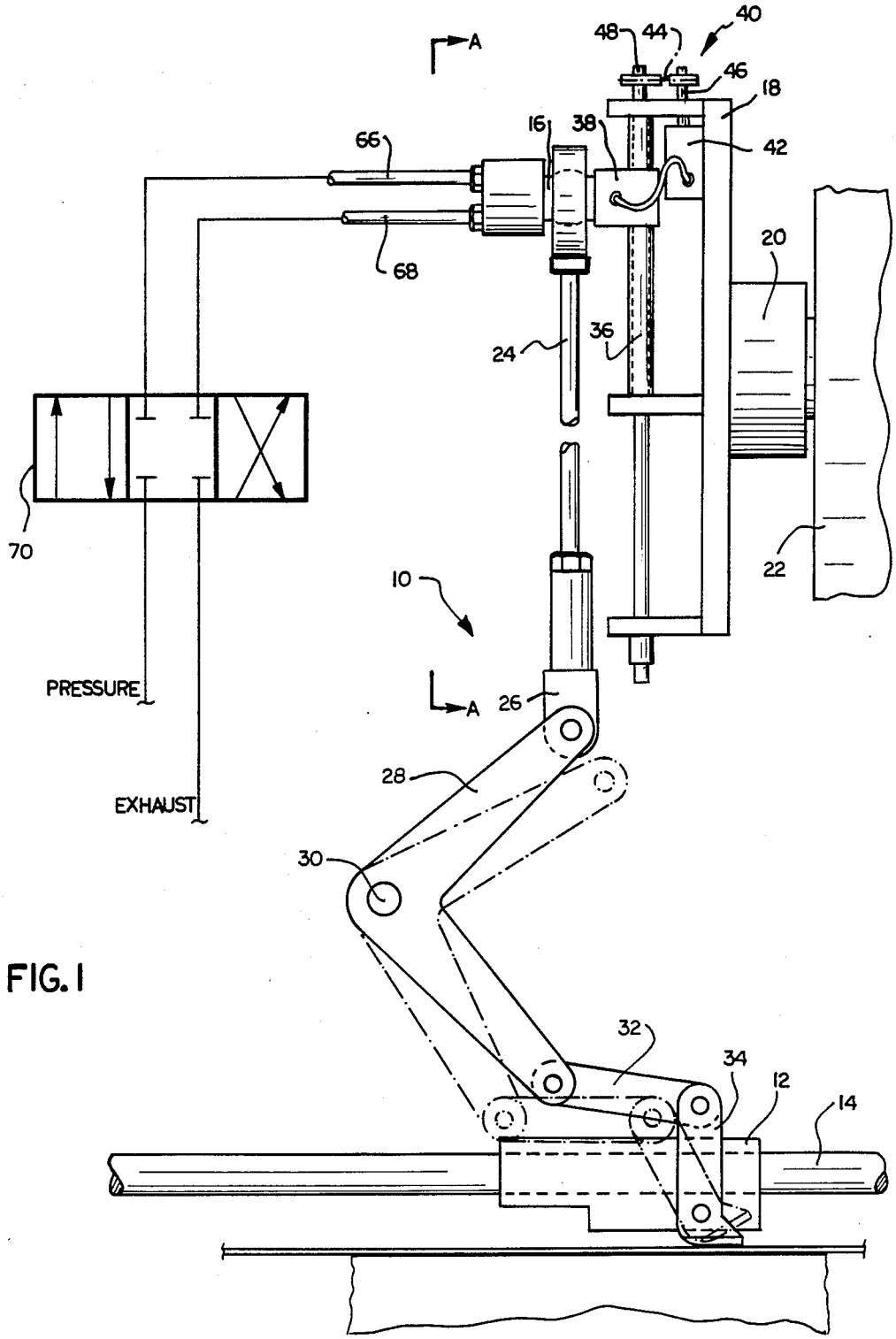
FIG. 1 is a schematic side elevational view of a punch press feed mechanism.
Figure 4:
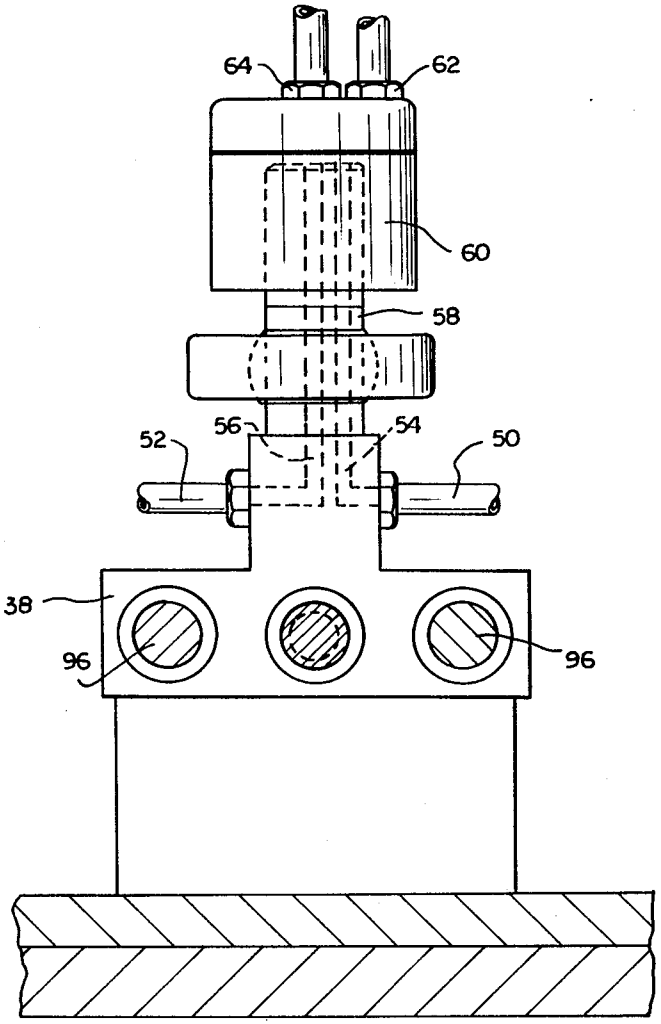
FIG. 4 is a view taken along lines 4—4 in FIG. 2.
Figure 2:
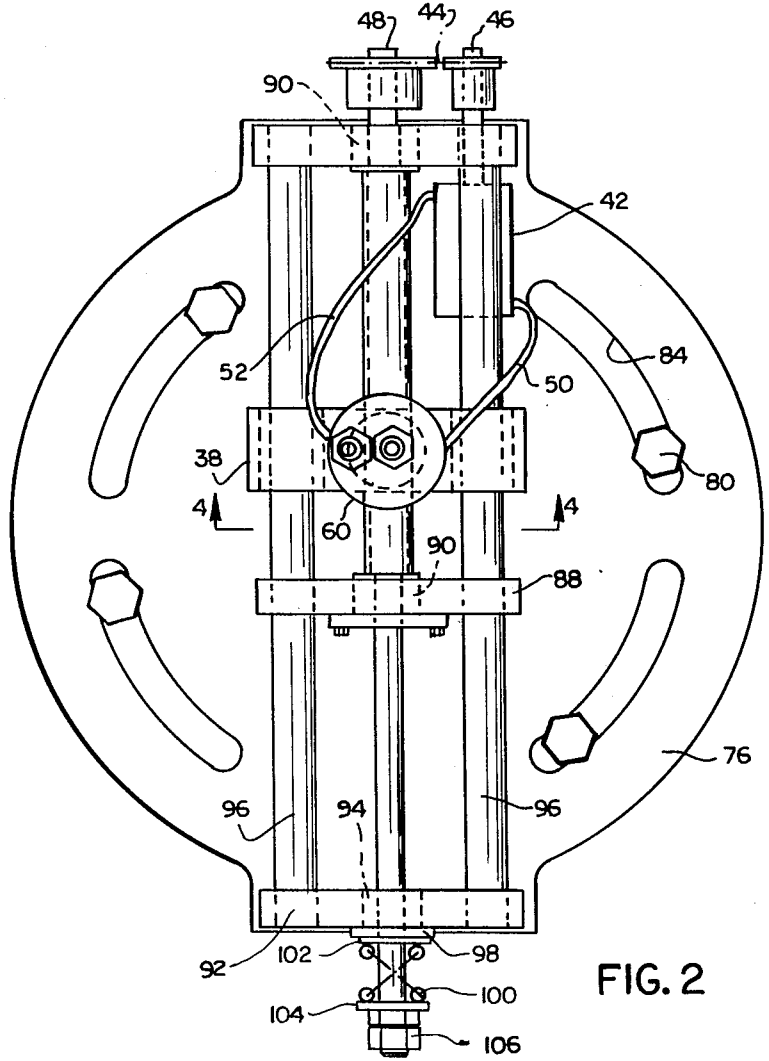
FIG. 2 is a elevational view of the feed adjustment mechanism of the present invention as viewed in the direction A—A in FIG. 1 and with parts omitted.
Figure 3:
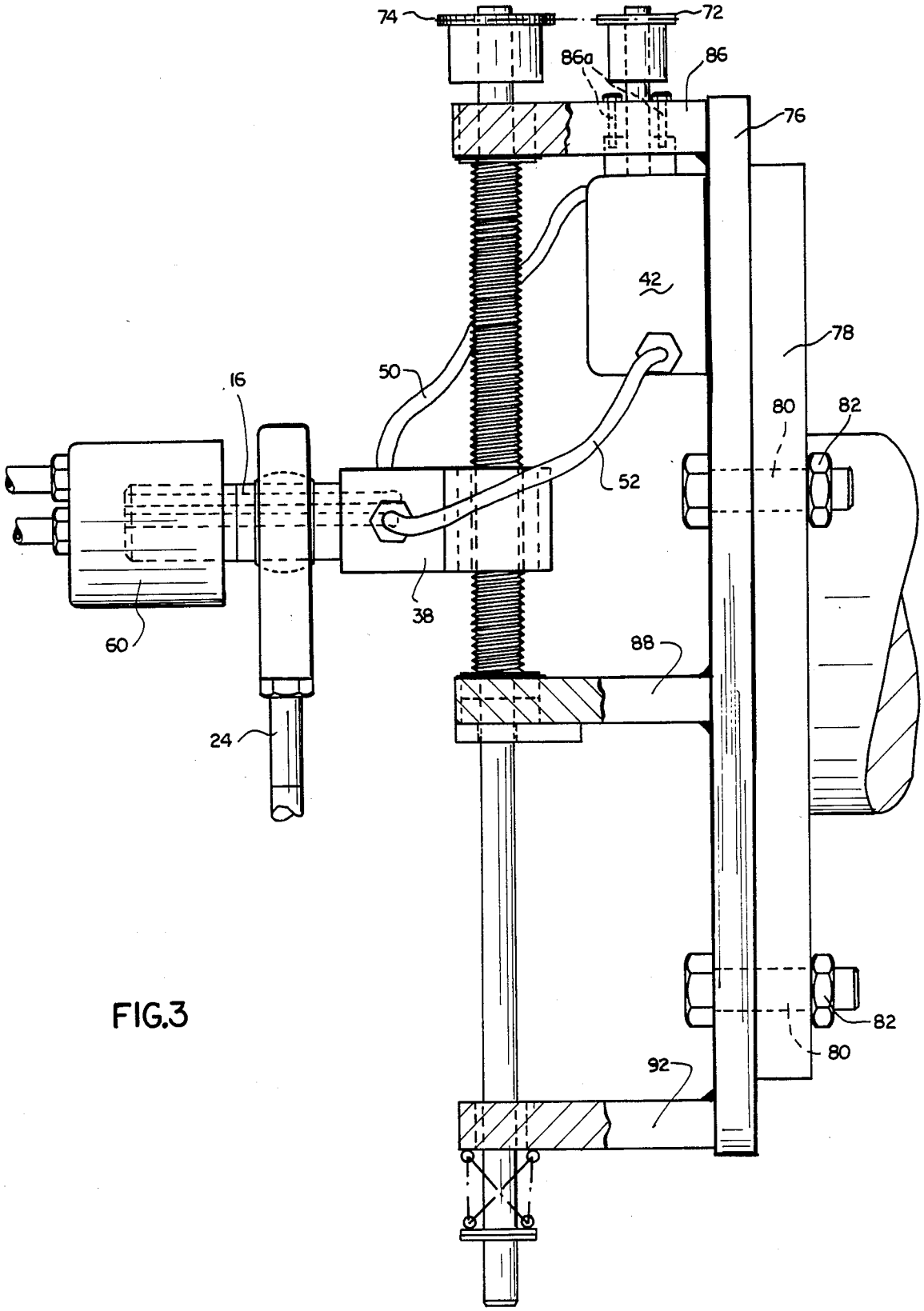
FIG. 3 is a side elevational view of the feed adjustment mechanism.

A feed mechanism 10 for feeding stock material into the working area of a punch press is shown schematically in FIG. 1. The feed mechanism 10 includes a feed block 12 for feeding the stock material. The feed block 12 is movable along a guide bar 14. The feed block 12 is driven from a crank pin means 16 which is adjustably mounted relative to the axis of the crank shaft by an apparatus embodying the present invention. The crank pin means 16 is connected by a link 24 through a universal joint 26 with one end of a generally L-shaped lever 28 (only one lever being shown in the drawings) pivotably mounted on a shaft 30. At its other end, the lever 28 is connected by a pivotal link 32 to a lever 34 which effects advancement of the feed block 12 with the stock material. The foregoing description only generally describes the feed mechanism, particularities of which are well known in the art and shown in U.S. Pat. No. 1,959,853, which is incorporated herein by reference.

The apparatus of the present invention comprises a throw member 18 carried by a crank shaft 20 of the punch crank press 22. The crank pin means 16 is mounted on the throw member 18. The apparatus further comprises a threaded rod 36 rotatably fixed on the throw member 18 and a nut 38 connected with the crank pin means 16 and movable along the threaded rod 36 when the latter rotates. A drive mechanism 40 is provided for rotating the threaded rod 36 to effect an automatic change of the length of the stock advance in accordance with the press operator demand, as will be described below.

The drive mechanism 40 is mounted on the throw member 18 and includes a motor 42 fixedly attached to the throw member 18 and a drive 44 that connects the output shaft 46 of the motor 42 with an extension 48 of the threaded rod 36 to rotate the same upon actuation of the motor. Preferably, motor 42 is a conventional reversible air motor, such as air power motor Model 5228-2A, manufactured by AKO Corporation, Bryan, Ohio. When air flows through one port into the motor, the motor rotates the threaded rod 36 in one direction. When air flows through the other port into the motor, the threaded rod is rotated in an opposite direction.

Air under pressure is supplied to a respective port of the motor 42 through a respective one of two flexible conduits 50 and 52 communicated with respective channels 54 and 56 in the body of the nut 38. The channels 54 and 56 extend through the crank pin 58 and a union member 60 and communicate with respective nipples 62 and 64 on the union member. Flexible conduits 66 and 68 communicate the union member with a fluid source and reservoir (not shown). The union member 60 enables rotation of the adjusting apparatus with the throw member 18 without twisting the flexible conduits 66 and 68. The union member 60 is a conventional known structure and thus will not be described in detail. A rotating dual passage union Model 1595-000-084 manufactured by Deublin Co., Northbrook, Ill., may be used. A solenoid valve 70 controls fluid flow from the fluid source into one of the conduits 66, 68 and from the other of the conduits 66, 68 to the reservoir.

The drive that transmits torque from the motor shaft 46 to the threaded rod 36 preferably includes two sprockets 72, 74 connected by a chain.

The throw member 18 comprises a plate 76 which is attached to a flange 78 fixedly mounted on the press crank shaft 20 by bolts 80 and nuts 82. The plate 76 is shown in the drawings as attached by four bolts 80 to the flange 78. The plate 76 is provided with slots 84 for adjustably attaching the plate 76 to the flange 78. Alternatively, the plate 76 may be provided with a hub for mounting directly on the press crank shaft.

A support plate 86 is fixed to the plate 76 and extends transverse thereto. A second plate 88 is fixed to the plate 76 approximately in the middle thereof. The support plates 86 and 88 support the threaded rod for rotation on the throw member. The motor 42 is attached to the plate 86 by four bolts **86*a* and is supported in abutting engagement with plate 76. The plates 86, 88 are welded to the plate 76 so that the whole structure of the throw member does not become loose under action of forces resulting from rotation of the throw member. Bearings 90 are mounted in the support plates 86 and 88 for supporting the threaded rod 36 for rotation therein. A third plate 92 is fixed to the plate 76 for supporting an extension of the threaded rod to provide a counterbalance feature. A bearing 94 is mounted in the plate 92 for rotatably supporting the extension of the threaded rod 76. Two guide rods 96 are fixed in the plates 86 and 92 for guiding the nut 38 along the threaded rod 36**.

A drag brake is provided to effect locking of the crank pin means 16 in a predetermined position with respect to the throw carrier member. The drag brake comprises a brake pad 98, and a brake tension spring 100 located between two washers 102 and 104. A nut 106 permits to adjust the brake force applied to the threaded rod. The drag brake is located beneath the third plate 92.

The length of the stock feed is adjusted as follows. When the length of the stock feed is to be adjusted, the press operator actuates the solenoid valves 70 to direct fluid flow through one of the conduits 66, 68, dependent on whether the length of the stock feed should be increased or decreased. The duration of fluid flow corresponds to the desired change in the length of the stock feed. When fluid flows through the motor 42, a torque is transmitted to the threaded rod 36 which rotates in a predetermined direction for a period of time necessary to effect the desired change in the length of the stock feed. As the threaded rod rotates, the crank pin means 16 moves therealong to a position that corresponds to the desired length of the stock feed, which length is determined by the eccentricity of the crank pin means relative to the axis of the crank shaft of the press.

The sizes of plates 76, 86, 88 and 92 and guide rods are chosen such that when the threaded rod, the drag brake, the motor, the threaded rod drive, and the crank pin are mounted on the throw member, the distribution of weight with respect to the axis of the crank shaft is substantially balanced so that excessive centrifugal force does not act on the crank shaft. Specifically, the weight of the portions of the rod 36, plates 88 and 90, and throw member 76 projecting on one side of the axis of the crank offset the weight projecting on the other side of the axis of the crank.

It is to be understood that the form of the invention herewith shown and described is to be taken as a preferred embodiment only, and that numerous variations may be made without departing from the scope of the invention as defined in the appended claims.

I claim:

1. An apparatus for adjusting the stroke of a stroke material feed mechanism used in a punch crank press, said stroke material feed mechanism including a feed block for advancing intermittently stock material into the working area of the punch crank press, rotatable crank pin means for effecting reciprocal movement of the feed block, and crank link means for transmitting rotational movement of the crank pin means into the reciprocal movement of said feed block, said apparatus comprising:

a throw member fixedly attached to the crank shaft of the punch crank press for joint rotation therewith, said crank pin means being attached to said throw member at a position offset from the axis of the crank shaft for joint rotation with said throw member, the distance between the axes of said crank shaft and said crank pin means determining the crank arm and, therefore, the amount of stock length advanced into the working area;

fluid motor means for displacing said crank pin means relative to said throw member to change the eccentricity of said crank pin means relative to the axis of said crank shaft and thereby the crank arm whereby the amount of stock length advanced into the working area is changed;

a threaded rod mounted on said throw member and a nut associated with said crank pin means and movable along said threaded rod upon rotation of said threaded rod to thereby change the eccentricity of said crank pin means, said fluid motor means effecting rotation of said thread rod means in a predetermined direction in response to actuation thereof by a press operator to thereby provide for longitudinal movement of said nut;

drive means for transmitting torque from said fluid motor means to said threaded rod;

said fluid motor means comprising a fluid motor, conduit means for directing fluid flow to and from said motor, and a valve for controlling fluid flow through said conduit means;

said throw member comprising a flange plate mounted on said crank shaft for joint rotation therewith and two spaced support plates extending transverse to said flange plate and fixed thereto for supporting said threaded rod for rotation;

said fluid motor being fixedly attached to said flange plate between said two support plates; and said conduit means comprising passage means extending through said crank pin means and said nut and flexible conduit means connected with said passage means.

2. Apparatus as set forth in claim 1 wherein said drive comprises two sprockets mounted, respectively, on the motor shaft and an extension of said threaded rod, and a continuous chain.

3. Apparatus as set forth in claim 1 further comprising a drag brake for locking said threaded rod against rotation when said motor means does not operate.

4. Apparatus as set forth in claim 1 further comprising means for substantially balancing said apparatus on the crank shaft.

5. An apparatus for adjusting a stroke of a stroke material feed mechanism used in a punch crank press, said stroke material feed mechanism including a feed block for advancing intermittently stock material into the working area of the punch crank press, rotatable crank pin means for effecting reciprocal movement of the feed block, and crank link means for transmitting rotational movement of the crank pin means into the reciprocal movement of said feed block, said apparatus comprising:

a throw member fixedly attached to the crank shaft of the punch crank press for joint rotation therewith, said crank pin means being attached to said throw member at a position offset from the axis of the crank shaft for joint rotation with said throw member, the distance between the axes of said crank shaft and said crank pin means determining the crank arm and, therefore, the amount of stock length advanced into the working area;

fluid motor means for displacing said crank pin means relative to said throw member to change the eccentricity of said crank pin means relative to the axis of said crank shaft and thereby the crank arm whereby the amount of stock length advanced into said working area is changed;

a threaded rod mounted on said throw member and a nut associated with said crank pin means and movable along said threaded rod upon rotation of said threaded rod to thereby change the eccentricity of said crank pin means, said motor means effecting rotation of said threaded rod means in a predetermined direction in response to actuation thereof by a press operator to thereby provide for longitudinal movement of said nut; and a drag brake for automatically locking said threaded rod against rotation when said motor means stops operating wherein said throw member comprises a flange plate attached to the crank shaft for joint rotation therewith, spaced first and second support plates extending transverse to said flange plate and fixed thereto for supporting said threaded rod for rotation at opposite ends thereof, said threaded rod having an extension and said throw member comprising a third plate extending transverse to said flange plate and fixed thereto for supporting said extension for rotation at the end thereof remote from the end of said threaded rod, said remote end of said extension having a portion projecting beyond said third plate, and wherein said drag brake comprises a brake pad mounted on said portion and adapted to engage said third plate, a nut spaced from said brake pad and threadably engaging said portion for adjusting the brake force applied to said threaded rod, and a tension spring extending between said brake pad and said nut for applying the brake force to said threaded rod.

6. An apparatus as set forth in claim 5 wherein said drag brake is spring-loaded.

7. An apparatus as set forth in claim 5 wherein said fluid motor means comprises a fluid motor fixedly attached to said flange plate between said first and second support plates and conduit means for directing fluid flow to and from said motor, said conduit means comprising passage means extending through said crank pin means and said nut and flexible conduit means connected with said passage means.

* * * * *